US009849715B2

(12) United States Patent
Tiberius et al.

(10) Patent No.: US 9,849,715 B2
(45) Date of Patent: Dec. 26, 2017

(54) CASE FOR DOCUMENT STORAGE ASSEMBLY

(71) Applicants: Medical Priority Consultants, Inc., Salt Lake City, UT (US); Jeffrey J. Clawson, Salt Lake City, UT (US)

(72) Inventors: Dennis E. Tiberius, Alpine, UT (US); Jeffrey J. Clawson, Salt Lake City, UT (US)

( * ) Notice: Subject to any disclaimer, the term of this patent is extended or adjusted under 35 U.S.C. 154(b) by 0 days.

(21) Appl. No.: 15/216,506

(22) Filed: Jul. 21, 2016

(65) Prior Publication Data

US 2017/0028767 A1 Feb. 2, 2017

Related U.S. Application Data

(60) Provisional application No. 62/197,846, filed on Jul. 28, 2015.

(51) Int. Cl.

| | |
|---|---|
| ***B42F 5/06*** | (2006.01) |
| ***B42F 7/06*** | (2006.01) |
| ***B42F 15/02*** | (2006.01) |

(52) U.S. Cl.

CPC ..... *B42F 5/06* (2013.01); *B42F 7/065* (2013.01); *B42F 15/026* (2013.01)

(58) Field of Classification Search

CPC .. B42F 17/18; B42F 7/00; B42F 17/00; B42F 19/00; B42F 17/08; B42F 17/28; B42D 1/08

USPC ..... 40/394, 391, 398; 211/40, 169

See application file for complete search history.

(56) References Cited

U.S. PATENT DOCUMENTS

| | | | | | |
|---|---|---|---|---|---|
| 1,314,425 | A * | 8/1919 | Quigley | B42F 17/18 | 40/391 |
| 3,225,769 | A * | 12/1965 | Uriarte Pina | B42F 19/00 | 312/348.3 |
| 3,291,545 | A * | 12/1966 | Bennett | B42F 17/08 | 312/183 |
| 4,320,591 | A * | 3/1982 | Dorman | B42D 1/08 | 40/124 |
| 4,426,007 | A * | 1/1984 | Beleckis | B42F 5/005 | 211/169 |

* cited by examiner

*Primary Examiner* — Cassandra H Davis

(74) *Attorney, Agent, or Firm* — John R. Thompson; Stoel Rives LLP

(57) ABSTRACT

According to various embodiments, a document storage tray includes a tray body and a document panel defining a document storage region. The tray further includes two internal alignment rails disposed in the interior of the tray body. The internal alignment rails are configured to facilitate an alignment of documents that are stored in the document tray via a plurality of alignment rods coupled to the rails and a plurality of document storage sleeves, configured to receive and house documents. A document stored in the document tray may be viewed, read, or accessed without requiring removal from the document storage tray. In this way, the embodiments may save the user time and allow the user to store and organize documents in a manner that will preserve the organization when the document is viewed or read.

17 Claims, 7 Drawing Sheets

CASE FOR DOCUMENT STORAGE ASSEMBLY

RELATED APPLICATION

This application claims the benefit under 35 U.S.C. §119 (e) of U.S. Provisional Patent Application No. 62/197,846, filed Jul. 28, 2015, and titled "DOCUMENT STORAGE TRAY," which is hereby incorporated by reference herein in its entirety.

TECHNICAL FIELD

This disclosure generally relates to a document storage tray.

BRIEF DESCRIPTION OF THE DRAWINGS

Non-limiting and non-exhaustive embodiments of the disclosure are described, including various embodiments of the disclosure with reference to the figures, in which.

In the following description, numerous specific details are provided for a thorough understanding of the various embodiments disclosed herein. The embodiments disclosed herein can be practiced without one or more of the specific details, or with other methods, components, materials, etc. In addition, in some cases, well-known structures, materials, or operations may not be shown or described in detail in order to avoid obscuring aspects of the disclosure. Furthermore, the described features, structures, or characteristics may be combined in any suitable manner in one or more alternative embodiments.

DETAILED DESCRIPTION

The present disclosure provides various embodiments of a document tray with pins for securing and aligning a plurality of document storage sleeves. According to various embodiments, a document tray may be configured with an internal rail to couple with clips and/or pins and may facilitate alignment of the plurality of document storage sleeves. When documents are disposed within one or more of the document storage sleeves of the plurality of document storage sleeves, the document tray may provide organization and alignment of the stored documents to allow convenient viewing of the stored documents without the need to remove them from the document storage sleeves.

A document storage tray may have a tray body with a planar region for document storage. Two ridges raised from the tray body may define two sides of the planar region. Further, two alignment rails may be coupled to the tray body.

In some embodiments, the two alignment rails may be disposed within the two ridges. A plurality of alignment rods may be coupled to the two alignment rails, and a plurality of document storage sleeves may be pivotally coupled to the alignment rods. The plurality of document storage sleeves may be stacked and spread such that each document storage sleeve succeeding a bottom storage sleeve at least partially overlays a preceding document storage sleeve thereby forming a tapered stack. In one embodiment, the raised ridges may taper at a slope equivalent to the tapered stack of document storage sleeves.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment.

Additionally, any of a wide variety of materials and manufacturing methods may be used to produce the various components of the presently described document tray for aligned storage of documents. For example, a tray may utilize various plastics, rubbers, nylons, glasses, metals, metal alloys, fabrics, leathers, and/or other suitable materials.

Figure 1:
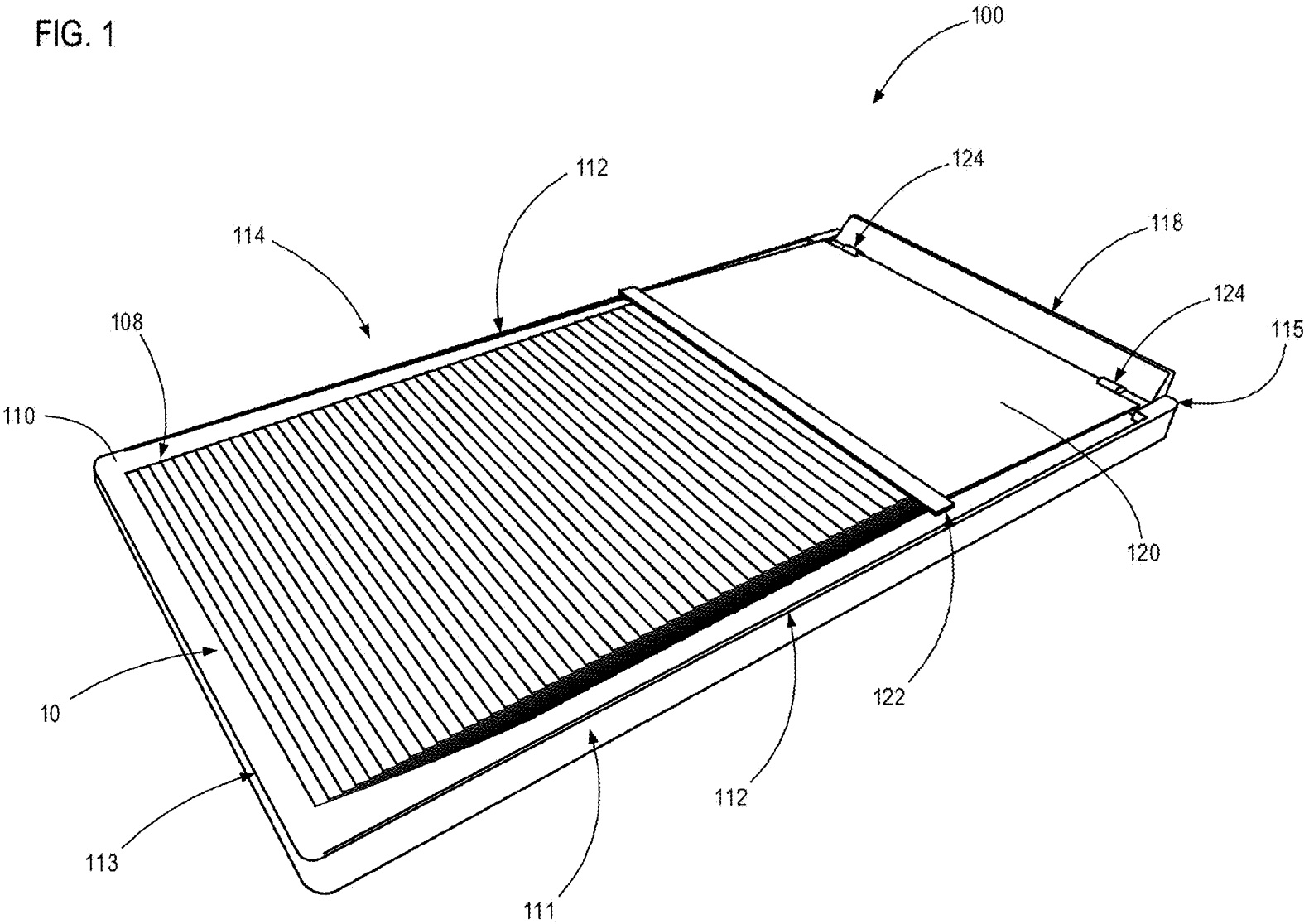
FIG. 1 is a side perspective view of a document storage tray, the tray in a storage configuration.

FIG. 1 is a side perspective view of a document storage tray 100, according to one embodiment. The document storage tray 100 may include a tray body 110, a document panel 120, and a plurality of document storage sleeves 10. The body of the document storage tray 100 may be of a rectangular shape, and of a size suitable for storing documents on a planar surface 108 of the tray body 110. Generally speaking, the document tray body 110 may be configured to facilitate document storage. The portion of the tray body 110 closest to the document panel 120 shall be referred to herein as the proximal portion of the tray 115, with the opposite portion of the tray referred to as the distal portion 113. Further, the lateral edge 111 of the tray body 110 is visible in FIG. 1.

The body of the document storage tray 110 may include a document storage region 114 and a document panel support 118. A pair of extended ridges 112 may be disposed adjacent to the lateral edges 111 of the tray body 110, and with a planar document surface 108 may form a document storage region 114. The two extended ridges 112 may be disposed in the tray body 110, along the intersection of the planar document surface 108 and the lateral tray edges 111. The height of the extended ridges 112 may truncate from the proximal end of the tray 115 to the distal end of the tray 113, such that the extended ridges 112 may terminate spatially prior to the distal end of the tray body 110.

This configuration of the extended ridges 112 may facilitate document storage, specifically by retaining the document storage sleeves 10 within the document storage region 114 defined by the extended ridges 112 and the planar document surface 108. Additionally, the height of the extended ridges 112 may truncate so that it can be approximately equal to the height of the plurality of document storage sleeves 10 at all points along the length of the document storage tray 100. As a result, the configuration of the extended ridges 112 may facilitate storage of the document storage tray 100 by allowing multiple document storage trays to be vertically stacked, with the base of one document storage tray 100 supported by the extended ridges 112 of the document storage tray positioned below it. In other embodiments, the extended ridges 112 may be of a greater height or width overall, or may be of a greater height or width at specific points. Further, the truncation of the extended ridges 112 may vary from the truncation of the extended ridges 112 shown in FIG. 1.

Speaking of the embodiments generally and individually, the document storage tray 100 may be of any suitable shape, size, or other relevant configuration. Such a configuration may allow the document storage tray 100 to store one or more documents of suitable size. Additionally, the document storage tray 100 may be capable of pivotally coupling one or more documents disposed within a storage sleeve with the tray body 110.

The planar document surface 108 may facilitate an organized arrangement/alignment of the document storage sleeves 10. A first document storage sleeve may be disposed on the planar document surface 108, with a second sleeve disposed to overlay the first sleeve. A third storage sleeve may similarly overlay the second sleeve. Additional storage sleeves may be disposed according to the same pattern, to overlay the prior storage sleeves disposed within the document storage region 114. As can be appreciated, the document storage region 114 may be of any suitable size to contain a corresponding plurality of document storage sleeves 10.

The document panel support 118 may be a wedge-shaped extension of the tray body 110, disposed in the proximal region. Further, the panel support 118 may be configured to receive the document panel 120 at an angle relative to the planar document surface 108, and may support a deployed document panel 120 against any downward force applied to it. This configuration of the support may prevent the document panel 120 and the tray body 110 from decoupling when a downward oriented force is applied to the document panel 120, such as when a number of documents overlay the panel or when a user presses on the panel. Additionally, the panel support 118 may serve to limit the rotational range of the document panel 120 to some predetermined value, specifically the degree of rotation at which the document panel 120 abuts the panel support 118.

The document panel 120 of the document storage tray 100 may facilitate the storage of the document tray, as well as increase the ease of viewing and accessing documents contained within the document storage tray 100. The document panel 120 may be referred to herein as the panel, the document viewing panel, or the rotatable panel. The document panel 120 may rotatably couple with the document storage tray body 110, and may transition between a storage configuration and a deployed configuration. In other embodiments, the characteristics of the document panel 120 described herein may vary.

Figure 2:
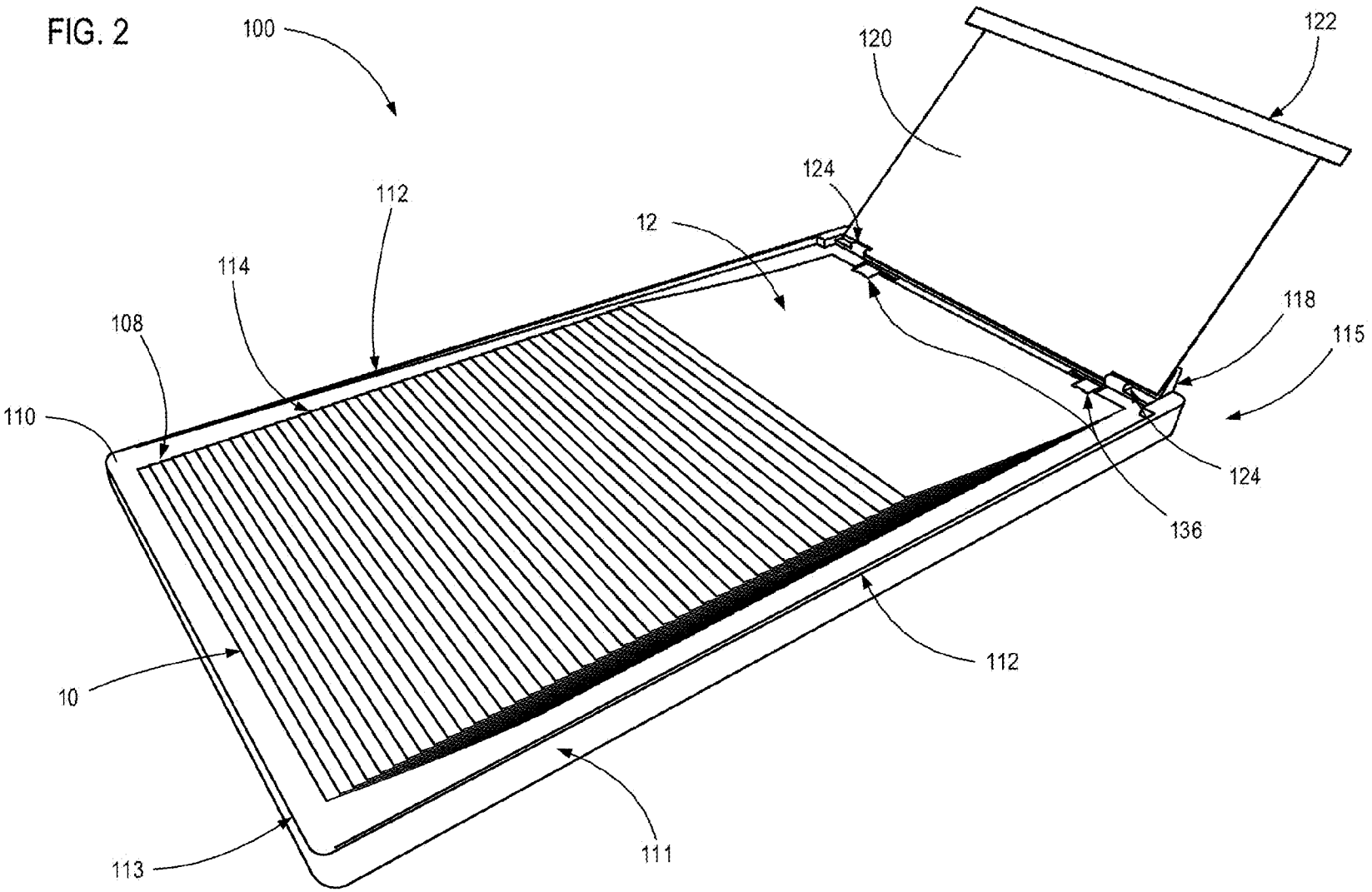
FIG. 2 is a side perspective view of the document storage tray, the tray in a deployed configuration.

FIG. 2 is a side perspective view of the document storage tray 100, with the document panel 120 in a deployed position. With the document panel 120 in a deployed position a user may overlay one or more document storage sleeves 10 upon the document panel 120.

The document panel 120 may be pivotally coupled with the body of the document storage tray 110 via any suitable system of pivotal coupling that may allow the document panel 120 to rotate away from the document tray body 110, to be received by the document panel support 118. In a particular embodiment, the document panel 120 and tray body 110 may be pivotally coupled via hinges disposed in the tray body 110. The document panel 120 may include two hinge rods disposed opposite one another in the lateral edges of the panel body. The hinge rods may be configured to couple with a corresponding pair of hinge lumens 124 that are disposed in the tray body 110. The hinge rods of the document panel 120 may be inserted into the hinge lumens 124 of the tray body 110, such that the rods may freely rotate within the lumens, but may be prevented from moving (i.e., laterally, horizontally, or vertically) while so coupled. Thus, a user may take the document panel 120 from a storage configuration to a deployed configuration by rotating the document panel 120 away from the document storage region 114 of the tray body 110 and toward the document panel support 118.

The document panel 120 may be configured to form an extended crosspiece 122 along its edge, to facilitate transitioning the panel from a storage configuration to a deployed configuration. The extended crosspiece 122 may allow a user to easily grasp or manipulate the document panel 120 and prevent unintentional grasping or undesired physical manipulation of any document storage sleeves 10 that the panel may overlay. As a result, the user may easily manipulate the extended crosspiece 122 of the panel, and thus the document panel 120 generally, without simultaneously grasping or manipulating the document storage sleeves 10.

In one embodiment, the extended crosspiece 122 may selectively couple the document panel 120 to the extended ridges 112. For example, the extended crosspiece 122 may lock to the extended ridges 112, and may need an uncoupling force that is greater than the gravitational force on the plurality of document storage sleeves 10 to uncouple the document panel 120 from the extended ridges 112.

A storage configuration of the document panel 120 may include when the document panel 120 is disposed adjacent to the plurality of document storage sleeves 10, partially overlaying them. When in the storage configuration, the document panel 120 may partially or significantly restrict the movement or rotation of the plurality of document storage sleeves 10, or of several storage sleeves individually. The storage configuration of the document panel 120 may facilitate storage of multiple document storage trays, by providing a planar surface upon which another similar document storage tray, or other suitable object, may be vertically stacked or placed.

Additionally, a deployed (i.e., extended) configuration of the document panel 120 may be defined as when the document panel 120 is rotated away from the document tray body 110, and abuts the document panel support 118. In the deployed configuration, the document panel 120 may receive one or more document storage sleeves of the plurality of document storage sleeves 10 to facilitate access/visibility of the documents housed in the sleeves. Thus, a user may rotate the document panel 120 away from the document tray body 110, overlaying the document panel support 118 with the document panel 120, and dispose one or more of the document storage sleeves 10 to overlay the deployed document panel 120. The user may then read, view, or otherwise access the documents in the storage sleeves overlaying the document panel 120.

The document panel 120 may be made of the same material as the document tray body 110. In other embodiments, the document panel 120 may be made of any suitably rigid and durable material. For example, the document tray body 110 may be made of a metal, metal alloy, plastic polymer, non-plastic, or other suitable material. The body of the document panel 120 may be of comparable size to a document storage sleeve, but may be slightly larger than a storage sleeve. The document panel 120 may be sized slightly larger than a storage sleeve to facilitate retention of a sleeve when placed on the document panel 120 such that the storage sleeve overlays the document panel 120.

Figure 3:
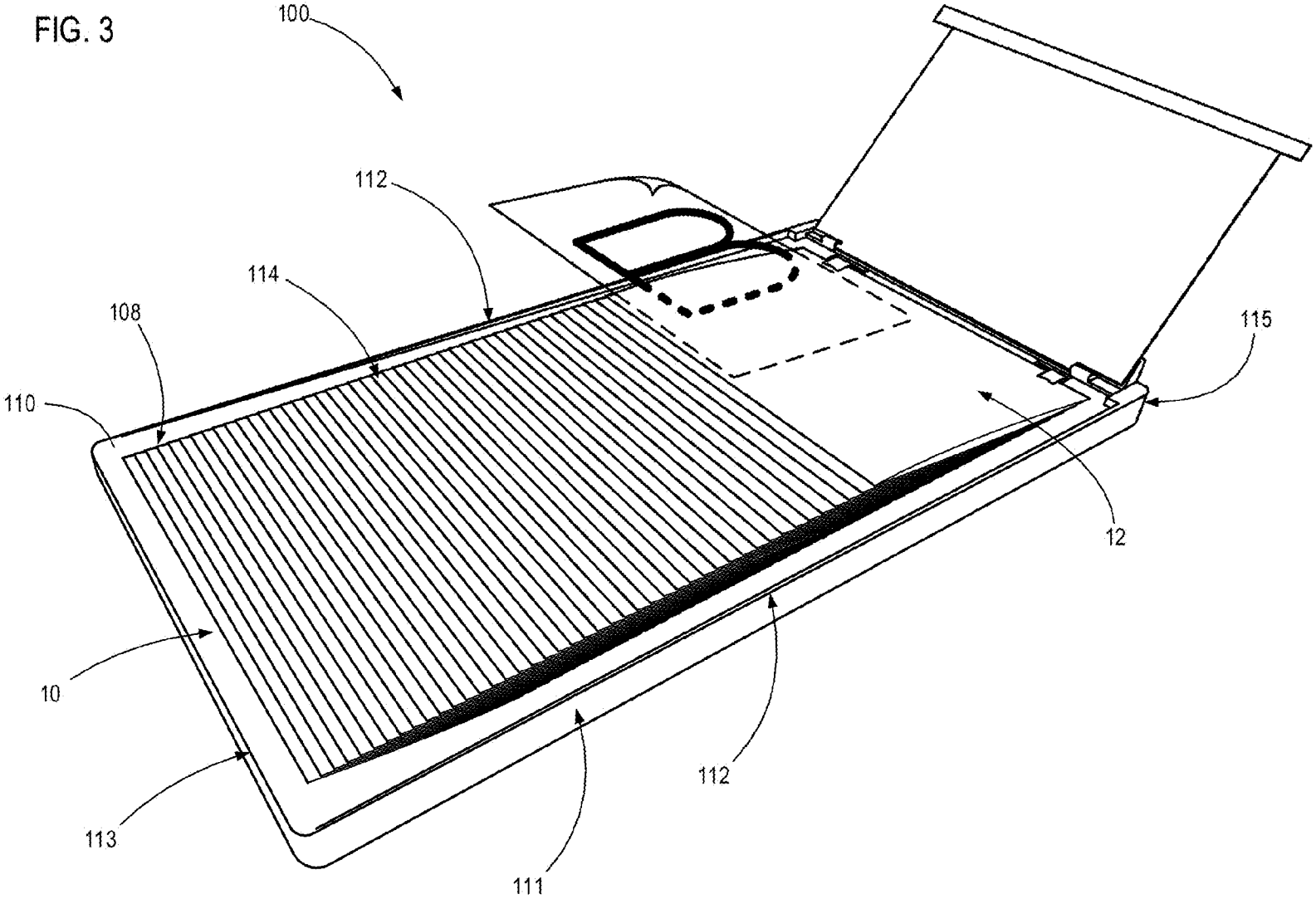
FIG. 3 is a side perspective view of the document storage tray, the tray receiving a document.
Figure 4:
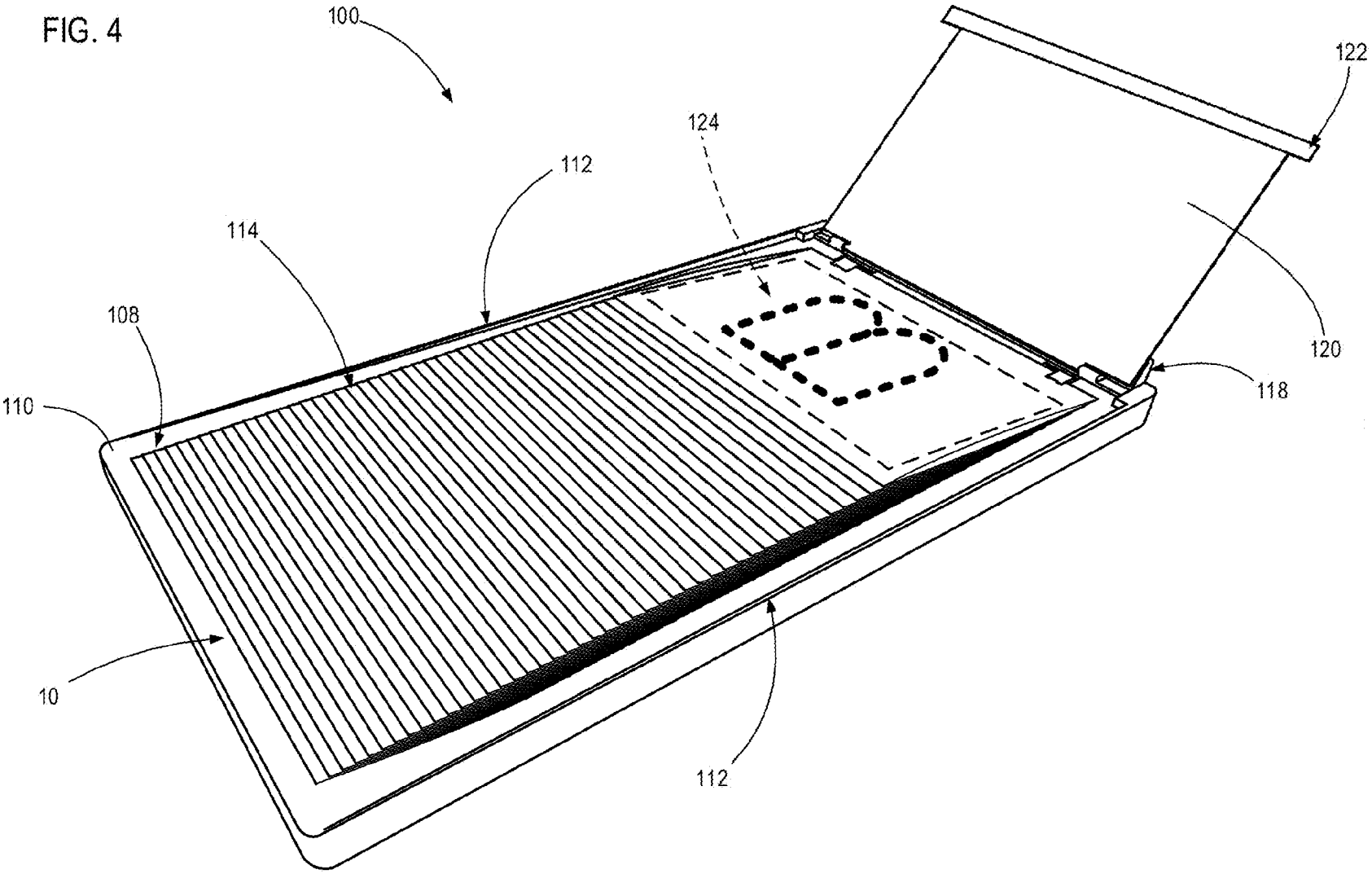
FIG. 4 is a side perspective view of the document storage tray, a document stored in the tray.
Figure 5:
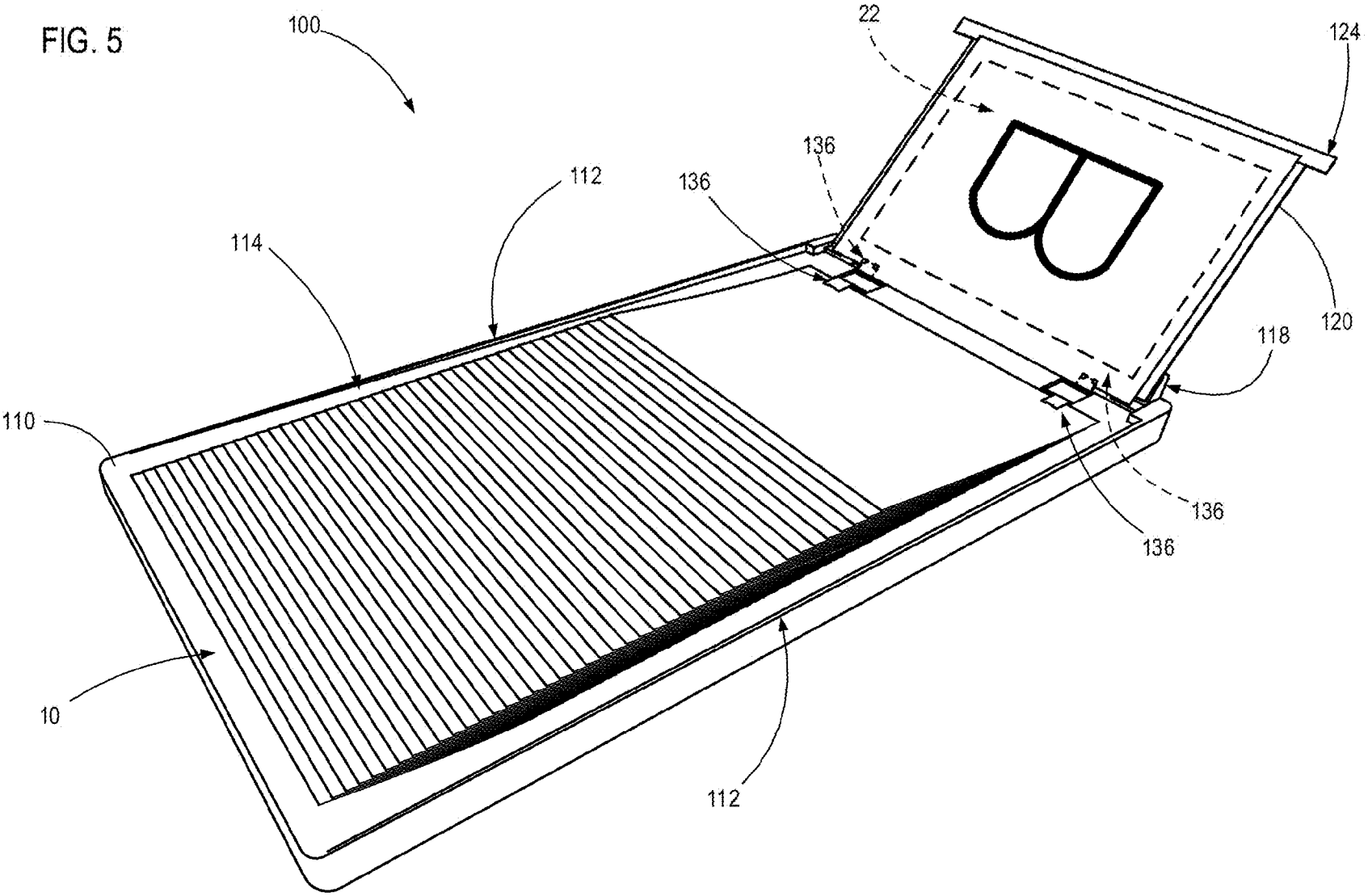
FIG. 5 is a side perspective view of the document storage tray, an occupied document storage sleeve disposed on a document panel.

FIGS. 3-5 are side perspective views of the document storage tray 100, with the document panel 120 in a deployed position and a document storage sleeve 12 receiving a document 22. A document storage sleeve of the plurality of document storage sleeves 10 may be configured to allow insertion of a document 22 and retention of the document 22 within the document storage sleeve 12. Ideally, such a system may facilitate an organization of one or more documents. Each storage sleeve may house or contain a document (e.g., a medical record or medical card), which may include printed text and/or graphics, each of potentially varying sizes. A document storage sleeve 12 may be configured to clearly display the document it contains to a user, so that the document 22 may be easily viewed by a user without requiring removal of the document 22 from the document storage sleeve 12. The document storage sleeves 10 may be configured to facilitate visibility of documents stored in their interior via the transparency of the document storage sleeve material.

The document storage sleeves 10 may be formed by a transparent or semi-transparent sheet of plastic folded along a center line to create two adjacent sleeve edges, disposed opposite the fold. The edges may be fastened together by two or more fasteners or clips 136 (e.g., U-clips). The secured edge of a document storage sleeve may be prevented from extending away from, or retracting toward, the tray body 110. Further, the configuration may prevent any lateral motion of the storage sleeve.

The document storage sleeve may include top and bottom edges, into which a document may be inserted. The top and bottom open edges of the document storage sleeve may be marginally separated by a user to facilitate insertion of a document into the document storage sleeve. The edges may then return to their original positions prior to being marginally separated by the user. In their original positions the top and bottom edges may secure the document within the document storage sleeve, and may prevent the document from unintentionally exiting the document storage sleeve.

Each of the storage sleeves may be substantially aligned to uniformly arrange the document storage sleeves 10 within the document storage region 114. Further, the document storage sleeves 10 may couple with the tray body 110 at evenly spaced intervals. The document storage sleeves 10 may be pivotally coupled with the tray body 110 via one or more clips 136.

As can be appreciated, the storage sleeve may be of any sufficiently flexible material to permit bending, or otherwise manipulating, of the storage sleeve (e.g., during insertion into or removal of the sleeve from the document tray), without permanent distortion of the storage sleeve. Further, the plurality of document storage sleeves 10 may partly include, or may be wholly composed of, document storage sleeves that are configured to couple with a preexisting document storage tray, such that the sleeves of the document storage tray 100 and the storage sleeves for another preexisting document storage tray may be substantially or completely interchangeable.

Figure 6:
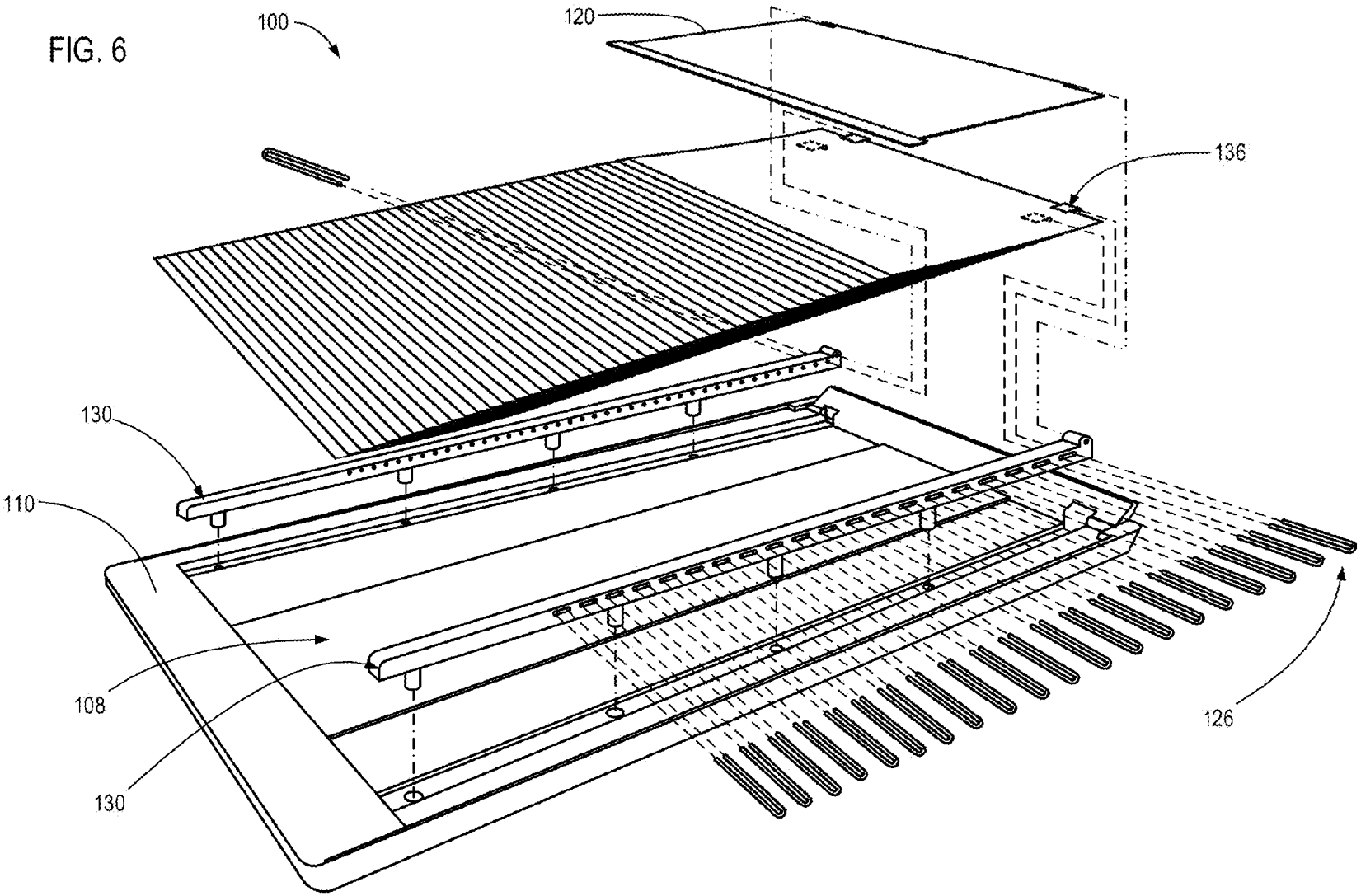
FIG. 6 is an exploded view of the document storage tray, the tray including an alignment rail and corresponding rods.

FIG. 6 is an exploded side perspective view of the document storage tray 100, with the alignment rails 130 and alignment rods 126 visible.

The document storage tray 100 may further include two alignment rails 130, disposed parallel to each other. The two alignment rails 130 may be configured to significantly align the plurality of document storage sleeves 10. The two alignment rails 130 may be separated by a particular distance that is roughly equal to the size of the storage sleeves. In other embodiments, the distance between the two alignment rods 126 may be slightly less than the height of a storage sleeve to facilitate coupling of the clips 136 and the alignment rails 130. The alignment rails 130 may be disposed between the proximal and distal ends of the tray body 110, with the alignment rails 130 parallel to each other and the lateral tray edges. In some embodiments, the alignment rails 130 may be formed by the tray body 110 such that the two are a single unitary body. In other embodiments, the rails may be formed separately from the tray body 110, and may be fastened to the tray body 110, to be disposed within the tray body 110.

Several alignment rods 126 may be configured to couple with the alignment rails 130. The alignment rods 126 may be a single piece of unitary material, with two extended shafts, connected by a perpendicular portion forming the rod into a "U" shape. The alignment rods 126 may be disposed in the alignment rails 130 at uniformly spaced intervals, and each extended shaft may engage a corresponding opening in an alignment rail 130. As can be appreciated, the size of the interval between alignment rods 126 may vary, as well as the length of each extended shaft of a particular alignment rod 126. Moreover, the flattened portion of an alignment rod may be of any suitable length for the arrangement of alignment rod openings disposed in the alignment rail 130 of the document tray 100.

The alignment rods 126 may be configured by their diameter, length, or shape to couple with the corresponding clips 136. The rods 126 may further be configured to facilitate marginal movement of the clips 136 along the length of the rod 126, particularly for insertion into and removal of a document storage sleeve 12, when the clip 136 and rod 126 must be coupled/decoupled. For a particular embodiment, a document storage sleeve 12 may be removed by marginally bending the sleeve 12 and sliding the corresponding clips 136 inward, or away from the alignment rails 130, along the length of their respective alignment rods 126. The document storage sleeves may be removed from their respective fasteners/clips 136 by any suitable method of removal, such as snapping, traveling a marginal distance along a coupling rail, or otherwise disengaging the document storage sleeves from a suitable method of pivotal coupling. As can be appreciated, the alignment rods 126 may be made of any suitably rigid material, such as metal, metal alloy, or plastic.

Some embodiments may include one or more clips 136 configured to couple with the plurality of storage sleeves to pivotally couple the sleeves with the tray body 110. These clips 136 may be configured by their dimensions such that the U-clip body may be of a rectangular shape. As can be appreciated, the clips 136 may be of any suitable shape, such as triangular, circular, ring, or polygonal. The clips 136 may be made of metal, plastic, or any other suitably rigid and durable material.

The clips 136 may also include two extended members, configured to couple with a document storage sleeve. The clips 136 may be configured to form two lumens that may receive an alignment rod 126. The clip lumens may be formed by a folded or otherwise shaped portion of the material of the clip itself, in order to facilitate coupling with a corresponding alignment rod 126. The clip lumens may receive the corresponding alignment rod 126 and pivotally couple the clip 136 with the alignment rails 130, in which the alignment rod 126 is disposed. With the alignment rod 126 and the corresponding clip 136 coupled, the clip 136 may pivotally couple a document storage sleeve 12 with the tray body 110. As can be appreciated, a document storage sleeve 12 may be coupled to the document storage tray 100 by more than one clip 136, with at least one clip 136 coupling with each of the two alignment rails 130 disposed in the document tray body 110. Thus, a document storage sleeve 12 may be pivotally coupled with the tray body 110, with the document storage sleeves 10 aligned.

As can be appreciated, the clips 136 may couple with the document storage sleeves 10 by any suitable method for that particular clip or pin. In one embodiment the clips 136 may couple with the lateral edges of a storage sleeve. More specifically, the clip may couple with the two edges of the folded sleeve that are disposed opposite the folded edge of the sleeve. To couple the clips 136 with the storage sleeve, the two folded extensions of the clip 136 may be fed through the corresponding holes disposed in the storage sleeve.

The folded extensions of a clip 136 may facilitate securing the clip 136 to a document storage sleeve 12 and may prevent unintended decoupling of the clip 136 and sleeve 12. In some embodiments, the extensions of the clip 136 may initially be orthogonal, forming a 90-degree angle with the clip body. The extended members may be inserted into the corresponding holes in the document storage sleeve 12, and later folded to pinch or otherwise secure the document storage sleeve 12. In other embodiments, the clip extensions may be previously folded to secure a document storage sleeve coupled with the clip 36. Any suitable configuration of a clip/fastener may join the two separate edges of a folded sheet to form the document storage sleeve.

The plurality of clips/fasteners 136 may be pivotally coupled with corresponding alignment rods 126 to fix the position of the clips 136 relative to the alignment rails 130. One or more clips 136 may secure a sleeve to the document storage tray 100. One or more clips may be coupled with an alignment rail 130, and at least one other clip may be coupled with the other alignment rail 130. As described previously, a document storage sleeve and its corresponding clips 136 may pivot or rotate relative to the tray body 110, allowing a user to browse the document storage sleeves 10 without removing any sleeves or substantially altering their alignment.

As can be appreciated, other suitable methods of coupling the document storage sleeves 10 and tray body 110 are considered. In other embodiments, the clips 136 may be replaced by pins that may be used to secure the storage sleeves to the tray body 110. A pin may engage with a corresponding fixture disposed in the tray body 110, or wrap around a corresponding alignment rod 126 disposed in an alignment rail 130. The pin may extend through a corresponding hole disposed in a document storage sleeve 12. The coupling pin may include a pin head of sufficient size to couple with the hole disposed in the document storage sleeve, but may be marginally larger than the corresponding hole. Thus, the pin head may facilitate securing the storage sleeve to the pin.

The document storage tray 100 may be configured such that the order of any two document storage sleeves, of the plurality of storage sleeves, can be interchanged. Specifically, two storage sleeves may be decoupled from their corresponding coupling clips 136. One of the decoupled storage sleeves may be coupled with one of the now vacant sets of clips 136, with the second storage sleeve likewise recoupled with the second vacant set of clips 136. Thus, the two storage sleeves may interchange their order or arrangement within the plurality of storage sleeves without removing the documents from their respective sleeves. Moreover, the document storage sleeves 10 may be completely or partially reordered or otherwise rearranged in any suitable manner according to the means of coupling the storage sleeves with the document tray body 110.

Figure 7:
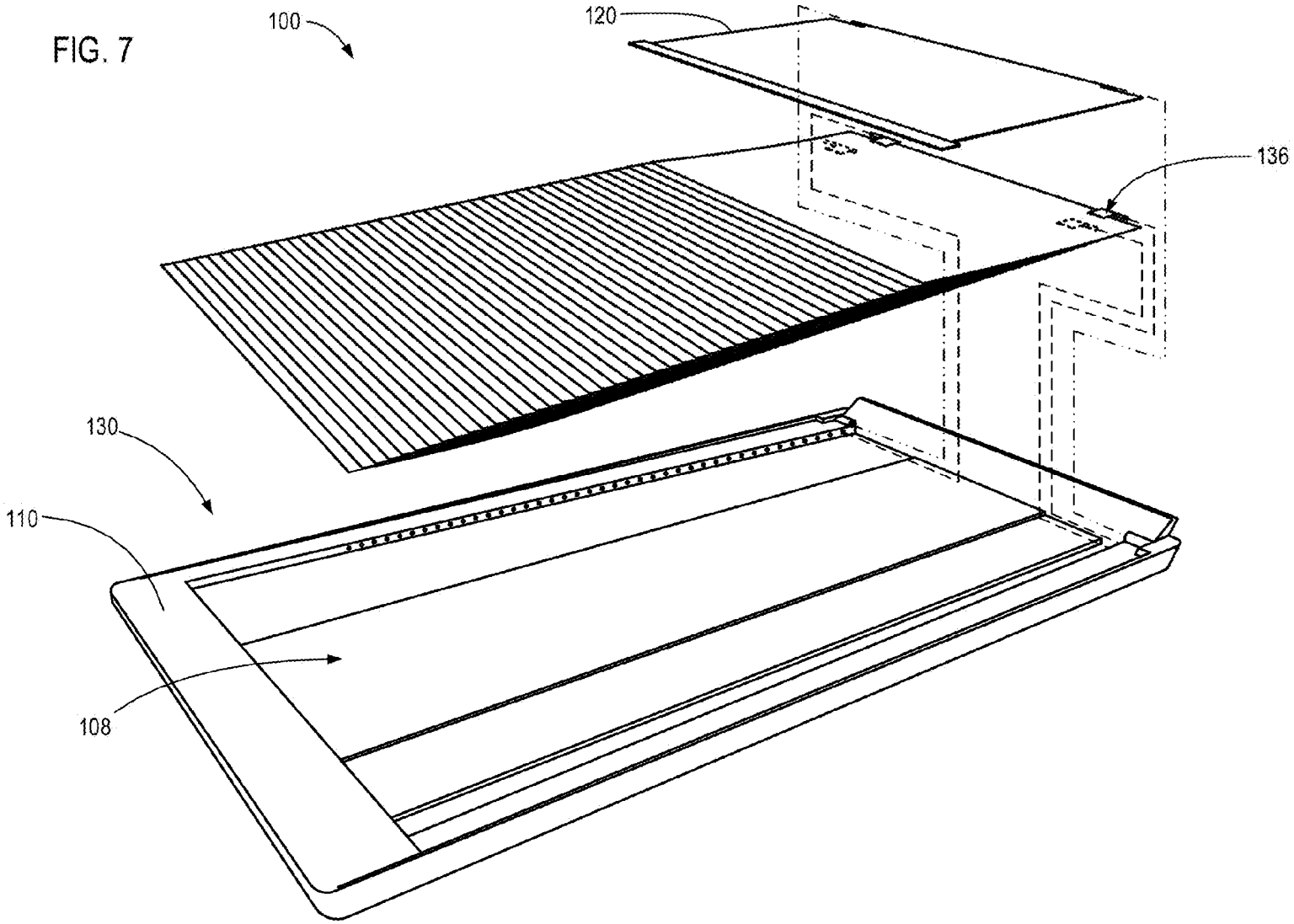
FIG. 7 is an exploded view of the document storage tray, the tray including alignment fixtures formed in the body of the document storage tray.

FIG. 7 depicts another embodiment of a document storage tray 200 that can resemble the document storage tray 100 described above in certain respects, and that can be compatible with the document storage sleeves 10. Accordingly, like features are designated with like reference numerals, with the leading digits incremented to "2." Relevant disclosure set forth above regarding similarly identified features thus may not be repeated hereafter. Moreover, specific features of the document storage tray 200 may not be shown or identified by a reference numeral in the drawings or specifically discussed in the written description that follows. However, such features may clearly be the same, or substantially the same, as features depicted in other embodiments and/or described with respect to such embodiments. Accordingly, the relevant description of such features applies equally to the features of the document storage tray 200. Any suitable combination of the features and variation of the same described with respect to the document storage tray 100 can be employed with the document storage tray 200, and vice versa.

FIG. 7 is an exploded side perspective view of a document storage tray 200, according to one embodiment. The document storage tray 200 may include one or more alignment fixtures 230 formed in the tray body 210.

The figure is one embodiment in which the alignment rails are substituted with several coupling fixtures 230 that may couple with the clips 236 directly. In certain embodiments, the alignment fixtures 230 may be connected to the interior of the tray body 210, or the tray body 210 may form the alignment fixtures 230 directly. The alignment fixtures 230 are configured to directly receive or couple with corresponding clips/pins 236.

As shown, the planar surface 208 may be recessed for document storage. Because the planar surface 208 is recessed, the tray body may form a plurality of walls around the recessed planar region. These walls may be used as alignment rails. In some embodiments, the recessed planar surface 208 may be angled relative to the document storage tray 200. For example, the angle of the recessed planar region may have a slope equivalent to the tapered stack of document storage sleeves. In another embodiment, a panel support may be formed from an angled wall at a deep end of the recessed planar surface 208.

The above description provides numerous specific details for a thorough understanding of the embodiments described herein. However, those of skill in the art will recognize that one or more of the specific details may be omitted, or other methods, components, or materials may be used. In some cases, operations are not shown or described in detail. Additionally, features or elements described in conjunction with any one embodiment may be adapted for use with and/or combined with the features of any other embodiment.

What is claimed:

1. A document storage tray comprising:

a tray body with a planar region for document storage;

two ridges raised from the tray body defining two sides of the planar region;

two alignment rails coupled to the tray body, wherein the two alignment rails are disposed within the two ridges;

a plurality of alignment rods coupled to the two alignment rails; and a plurality of document storage sleeves pivotally coupled to the alignment rods, wherein the plurality of document storage sleeves are stacked and spread such that each document storage sleeve succeeding a bottom storage sleeve at least partially overlays a preceding document storage sleeve thereby forming a tapered stack;

a rigid document panel pivotally coupled to the tray body to transition between a storage configuration and a deployed configuration, wherein the document panel at least partially overlays a top storage sleeve from the plurality of document storage sleeves when in the storage configuration, and provides support to one or more of the plurality of document storage sleeves when in the deployed configuration; and a panel support coupled to the tray body to receive the document panel at a target angle relative to the tray body when the document panel is in the deployed configuration.

2. The document storage tray of claim 1, wherein the alignment rods are fixedly coupled to the two alignment rails.

3. The document storage tray of claim 1, wherein each of the plurality of document storage sleeves includes two or more clips to selectively couple the storage sleeves to the alignment rods.

4. The document storage tray of claim 1, wherein each of the plurality of document storage sleeves includes two or more clips, and wherein at least one alignment rail includes a plurality of alignment fixtures to pivotally couple with two or more clips.

5. The document storage tray of claim 1, wherein the two ridges taper at a slope equivalent to the tapered stack.

6. The document storage tray of claim 1, wherein the document panel includes an extended crosspiece to facilitate manipulation of the document panel.

7. The document storage tray of claim 6, wherein the extended crosspiece selectively couples the document panel to the two ridges.

8. The document storage tray of claim 7, wherein an uncoupling force must be greater than a gravitational force of the plurality of document storage sleeves to uncouple the document panel from the two ridges.

9. The document storage tray of claim 1, wherein the panel support is formed from the tray body.

10. A document storage tray comprising:

a tray body with a recessed planar region for document storage, the tray body forming a plurality of walls around the recessed planar region, wherein the recessed planar region is angled relative to the tray body;

at least one alignment rail coupled to the tray body, wherein at least one alignment rail is disposed within at least one of the plurality of walls around the recessed planar region;

a plurality of alignment rods coupled to the at least one alignment rail; and a plurality of document storage sleeves pivotally coupled to the plurality of alignment rods, wherein the plurality of document storage sleeves are stacked and spread such that each document storage sleeve succeeding a bottom storage sleeve at least partially overlays a preceding document storage sleeve forming a tapered stack.

11. The document storage tray of claim 10, wherein the angle of the recessed planar region has a slope equivalent to the tapered stack.

12. The document storage tray of claim 10, further comprising:

a rigid document panel pivotally coupled to the tray body to transition between a storage configuration and a deployed configuration, wherein the document panel at least partially overlays a top storage sleeve from the plurality of document storage sleeves when in the storage configuration, and provides support to one or more of the plurality of document storage sleeves when in the deployed configuration; and a panel support coupled to the tray body to receive the document panel at a target angle relative to the tray body when the document panel is in the deployed configuration.

13. The document storage tray of claim 12, wherein the panel support is an angled wall at a deep end of the recessed planar region.

14. The document storage tray of claim 12, wherein each of the plurality of document storage sleeves includes two or more clips to selectively couple the storage sleeves to the alignment rods.

15. A document storage tray comprising:

a planar surface for document storage;

two alignment rails coupled to the planar surface;

a plurality of alignment rods coupled to the two alignment rails;

a plurality of document storage sleeves pivotally coupled to the plurality of alignment rods, wherein the plurality of document storage sleeves are stacked and spread such that each document storage sleeve succeeding a bottom storage sleeve at least partially overlays a preceding document storage sleeve forming a tapered stack, wherein the alignment rails taper at a slope equivalent to the tapered stack.

16. The document storage tray of claim 15, further comprising:

a rigid document panel pivotally coupled to the planar surface to transition between a storage configuration and a deployed configuration, wherein the document panel at least partially overlays a top storage sleeve from the plurality of document storage sleeves when in the storage configuration, and provides support to one or more of the plurality of document storage sleeves when in the deployed configuration; and a panel support coupled to the planar surface to receive the document panel at a target angle relative to the planar surface when the document panel is in the deployed configuration.

17. The document storage tray of claim 16, wherein the document panel includes an extended crosspiece to facilitate manipulation of the document panel and selectively couple the document panel to the planar surface, wherein an uncoupling force must be greater than a gravitational force of the plurality of document storage sleeves to uncouple the document panel from the planar surface.

* * * * *